US005300738A

United States Patent [19]

Kostka et al.

[11] Patent Number: 5,300,738

[45] Date of Patent: Apr. 5, 1994

[54] APPARATUS FOR REGISTERING AND INDICATING HALL CALLS AT AN ELEVATOR ENTRYWAY WITH A TICKET DISPENSER

[75] Inventors: Miroslav Kostka, Ballwil, Switzerland; John Chapman, Randolph, N.J.

[73] Assignee: Inventio AG, Hergiswil, Switzerland

[21] Appl. No.: 951,896

[22] Filed: Sep. 28, 1992

[30] Foreign Application Priority Data

Sep. 27, 1991 [CH] Switzerland ..... 02867/91

[51] Int. Cl.[5] ..... B66B 1/14; B66B 3/00

[52] U.S. Cl. ..... 187/121; 187/139; 187/137

[58] Field of Search ..... 187/121, 130, 138, 139, 187/126, 137; 221/9

[56] References Cited

U.S. PATENT DOCUMENTS

| | | | |
|---|---|---|---|
| 4,370,717 | 1/1983 | Hummert et al. | 364/436 |
| 4,691,808 | 9/1987 | Nowak et al. | 187/125 |
| 4,915,197 | 4/1990 | Schroder | 187/121 |
| 4,972,926 | 11/1990 | Tsuji et al. | 187/137 |
| 4,991,694 | 2/1991 | Friedli | 187/127 |
| 5,042,620 | 8/1991 | Yoneda et al. | 187/124 |

FOREIGN PATENT DOCUMENTS

| | | | |
|---|---|---|---|
| 0050304 | 4/1982 | European Pat. Off. . | |
| 0050305 | 4/1982 | European Pat. Off. . | |
| 0320583 | 6/1989 | European Pat. Off. . | |
| 0144692 | 10/1980 | Fed. Rep. of Germany | 221/9 |

*Primary Examiner*—Steven L. Stephan
*Assistant Examiner*—Robert Napp
*Attorney, Agent, or Firm*—Howard & Howard

[57] ABSTRACT

A call registering and indicating device located at an elevator entryway issues a ticket to assist an inattentive or diverted passenger on a floor who overlooks the optical indication of the allocated elevator or forgets the noted indication prior to the arrival of an elevator. A printer and a ticket-issuing device are connected by a control circuit with the elevator group control. After the call entry and upon the call allocation, the printer and the ticket-issuing device are actuated and a ticket is issued the imprint of which indicates the selected destination floor and the allocated elevator.

12 Claims, 2 Drawing Sheets

APPARATUS FOR REGISTERING AND INDICATING HALL CALLS AT AN ELEVATOR ENTRYWAY WITH A TICKET DISPENSER

BACKGROUND OF THE INVENTION

The invention concerns elevator systems in general and, in particular, hall call registering and indicating apparatus located at elevator entryways.

A hall call registering and indicating apparatus having an indicating field with several indicating elements is shown in the European patent document EP-A 0 320 583. A first indicating element signals the selected destination floor in the form of a one-digit or two-digit decimal number and a second indicating element signals the allocated elevator in the shape of a capital letter. Further indicating elements signal a faulty call entry in the shape of a double question mark and the position of the allocated elevator relative to the actuated apparatus in the form of arrows directed to the left or to the right. The indicating elements are activated upon the call entry and call allocation by means of control circuits which are connected with a decade keyboard and with call storage devices connected to the decade keyboard and to a group control circuit. The indicating elements are formed of luminescent diodes which light up upon their activation and extinguish again after approximately two seconds.

Call registering and indicating apparatus of the kind described above are designed for group control equipment for elevators for which no call buttons are provided in the elevator cars. In such a group control circuit, which is shown in the European patent document EP-A 0 356 731, a call identifying the input floor and a call identifying the destination floor are stored for each elevator of the group upon the call entry at the input floor. Each elevator control includes a computer in the form of a microprocessor and a comparison device. Immediately after the registration of a call, the computer computes a sum, also called operating costs, corresponding to the mean waiting time of all passengers from data specific to the elevator. During an immediately following comparison of the operating costs of all elevators, the elevator with the lowest operating costs is ascertained, to which the call concerned is then allocated. As already described above, the allocated elevator is signaled optically for a short time in the indicating field of the actuated call registering and indicating apparatus. Inattentive waiting passengers or waiting passengers, for example, conducting a conversation can in that case overlook the indication or, when the indication was perceived only fleetingly, forget it again. If a different elevator traveling in the same direction is now used by mistake by the passenger, the probability is great that the desired destination floor is not reached. Since the indication must be present for a longer time to reduce the probability of such errors, for example one to two seconds, the performance capability of the call registering and indicating apparatus can be reduced greatly when used by a large number of passengers.

SUMMARY OF THE INVENTION

The present invention is based on the task of providing a hall call registering and indicating apparatus of the above described type, in which the perception of the indication of the selected destination floor and the indication of which elevator was allocated is more certain and requires less time for the indicating process. Accordingly, the call registering and indicating apparatus includes a decade keyboard for entering calls for desired destination floors and an indicating field which signals the selected destination floor and the allocated elevator. A printer and a ticket-issuing device are provided which are connected to the elevator group control. After the call entry and upon the call allocation, the printer and the ticket-issuing device are actuated to issue a ticket, the imprint of which indicates the selected destination floor and the allocated elevator.

The hall call registering and indicating apparatus according to the present invention is located at an elevator entryway at a floor for the immediate allocation of destination calls by a group control for the elevators. The apparatus includes a decade keyboard associated with the elevator entryway for entering calls to select desired destination floors; call storage devices connected between the decade keyboard and the group control; a first indicating element for signaling a selected destination floor associated with a call entered at the decade keyboard; and a first control circuit connected between the first indicating element and the decade keyboard. The apparatus also includes a second indicating element for signaling an elevator allocated by the group control to the call; a second control circuit connected between the second indicating element and the group control; a printer for printing tickets; a ticket-issuing device connected to the printer for issuing the printed tickets; and a third control circuit connected between the printer and the group control. The printer is actuated after entry of the call at the decade keyboard and upon allocation of the call to an elevator by the group control to print a ticket having an imprint of the selected destination floor and the allocated elevator.

The advantages to be achieved by the invention are that the passengers do not have to observe optical indications when actuating the keyboards of the registering and indicating apparatus since they receive a certain, permanent identification of the allocated elevator on the ticket. Thereby, the necessity of noting the identity of the allocated elevator also becomes superfluous. Since the relatively long time duration of the optical indication required in previous devices is reduced, this time is available for the use of the call registering and indicating apparatus by other passengers so that the number of the hall call registering and indicating apparatuses on a floor can be reduced.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
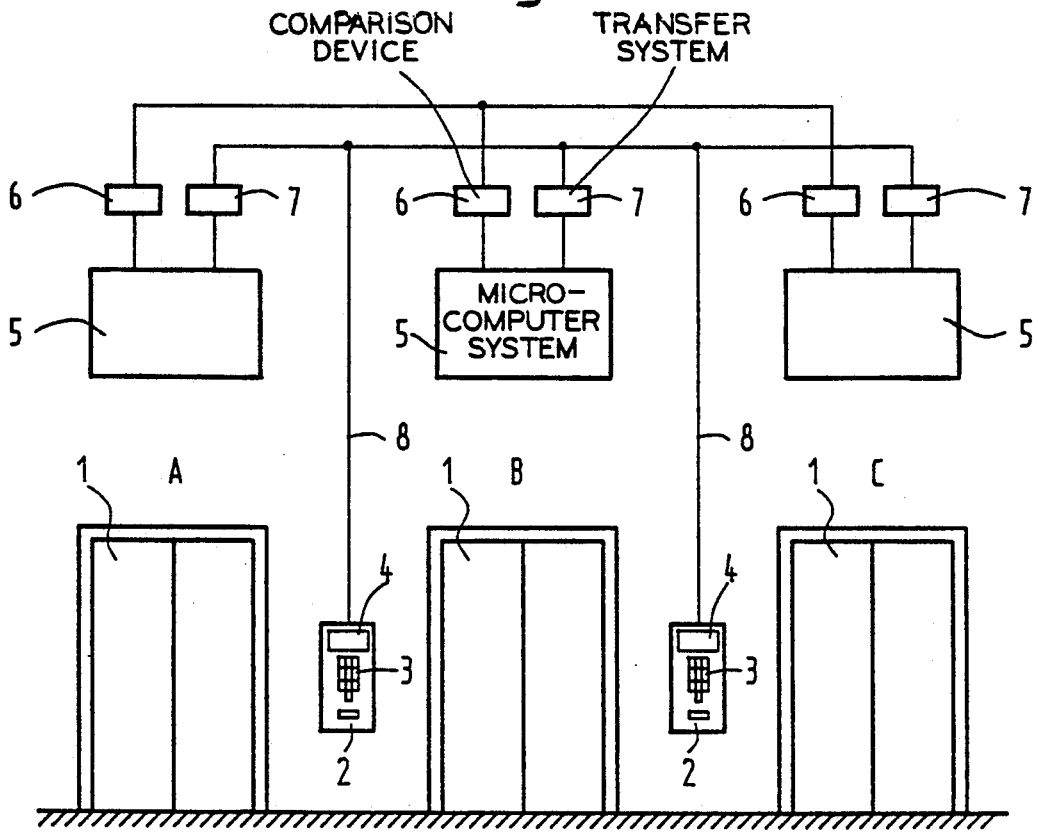
FIG. 1 is a schematic view of a hall call registering and indicating apparatus according to the present invention located at a floor adjacent an entryway for a group of three elevators.

In the FIG. 1, there is shown a group of three elevators, A, B and C, having shaft doors 1 at an entryway on a floor of a building. A pair of hall call registering and indicating apparatuses 2 are located between adjacent ones of the shaft doors 1 for entering calls for desired destination floors. For this purpose, the call registering and indicating apparatuses 2 each include a decade keyboard 3 for entering call information and an indicating field 4 for displaying at least the entered call and the allocated elevator. The elevators A, B and C are associated with a separate microcomputer system 5, which systems are connected one with the other by way of a comparison devices 6 shown in the European patent document EP-B 0 050 304 and a party line transfer system 7 shown in the European patent document EP-B 0 050 305. The microcomputers 5, comparison devices 6 and transfer systems 7 together form a group control, wherein the call registering and indicating apparatuses 2 are connected to a serial bus 8 which connects the transfer systems 7.

Figure 2:
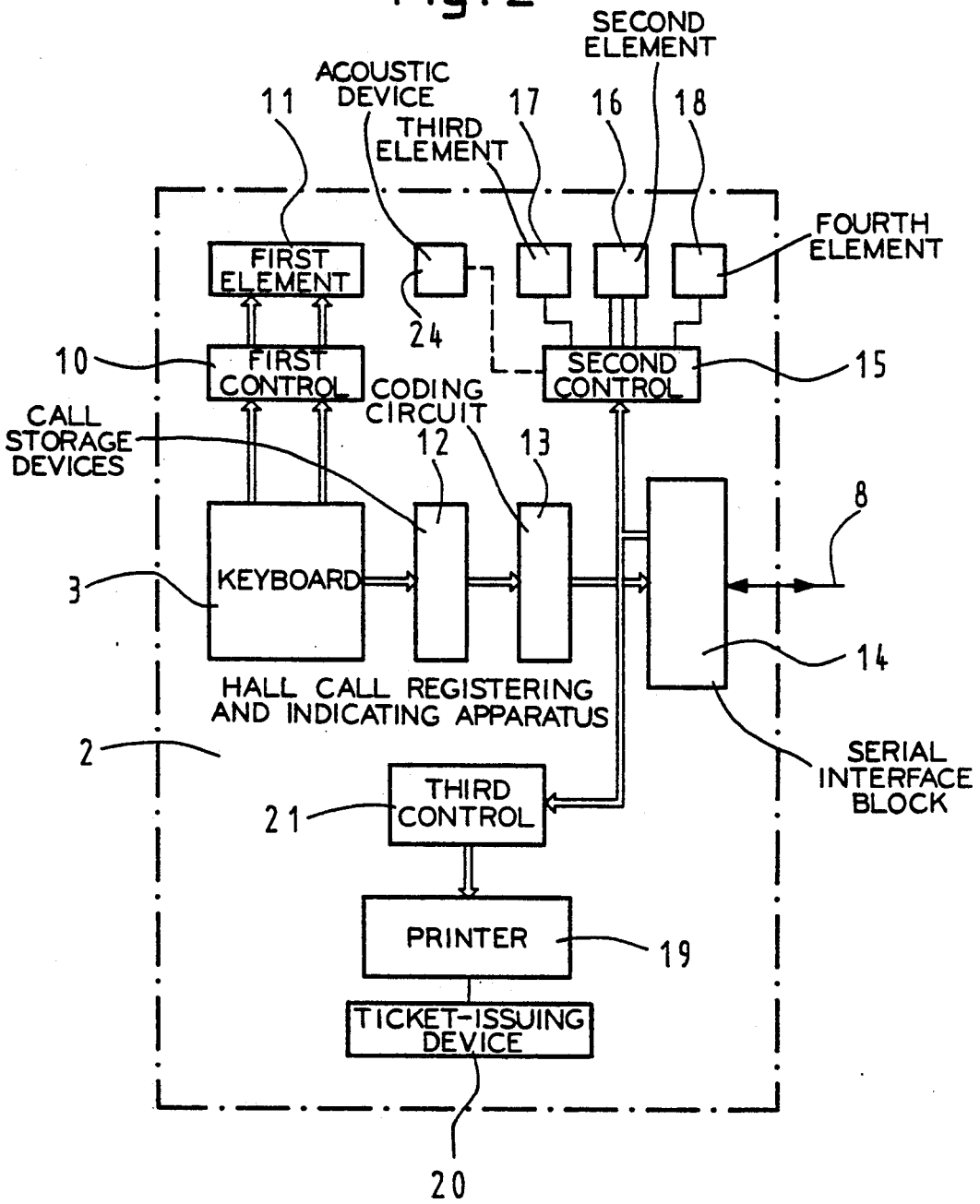
FIG. 2 is a block schematic diagram of the call registering and indicating apparatus shown in the FIG. 1.

As shown in the FIG. 2, the decade keyboard 3 of the call registering and indicating apparatus 2 has outputs connected with inputs of a first control circuit 10. The circuit 10 has outputs connected to inputs a first indicating element 11 for the indication of the entered destination floor. As is known from the previously referenced European patent document EP-A 0 320 583, the first indicating element 11 consists of seven-segment displays and the first control circuit 10 consists substantially of coding circuits. Other outputs of the decade keyboard 3 are connected to inputs of call storage devices 12 outputs of which are connected to inputs of a coding circuit 13. The circuit 13 has outputs connected with parallel data inputs of a serial interface block 14 having a port connected to the serial bus 8 (FIG. 1).

The serial interface block 14 has outputs connected to inputs of a second control circuit 15 which has outputs connected to inputs of a second indicating element 16, a third indicating element 17 and a fourth indicating element 18. As is likewise known from the aforementioned document EP-A 0 320 583, the indicating elements 16, 17 and 18 consist of luminescent diodes which are arranged in a raster. The letters "A", "B" and "C" can be formed by the second indicating element 16 upon activation to display the elevator allocated to the call. The letters "A" and "B" are shown in the FIGS. 3 and 4 respectively. An arrow directed to the left can be formed with the third indicating element 17 and an arrow directed to the right can be formed with the fourth indicating element 18 as shown in the FIGS. 3 and 4 respectively. These arrows are used to direct the passenger toward the allocated elevator. Accordingly, the second control circuit 15 consisting of a coding circuit has five outputs, three connected to the element 16, and one each connected to the elements 17 and 18.

A printer 19 and a ticket-issuing device 20, which are commercially available, can be provided. The printer 19 includes a matrix, the intersection points of which correspond to the pixels of the image to be printed. Inputs to the matrix are connected with outputs of a third control circuit 21 which includes a symbol generator in the form of a read-only memory for the driving of the columns of the matrix and an addressing circuit for the driving of the lines of the matrix. The third control circuit 21 is connected at inputs with the same parallel data outputs of the serial interface block 14 as are connected to the inputs of the second control circuit 15.

Figure 3:
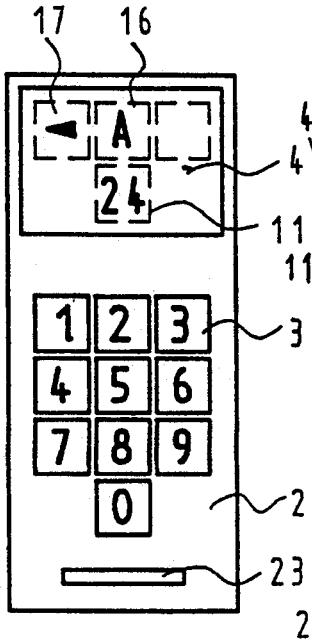
FIG. 3 is an enlarged front elevation view of the call registering and indicating apparatus shown in the FIG. 1 with an example of the information displayed.
Figure 4:
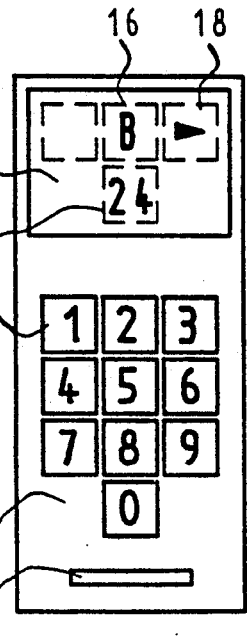
FIG. 4 is a view similar to the FIG. 3 with a different example of the information displayed.
Figure 5:
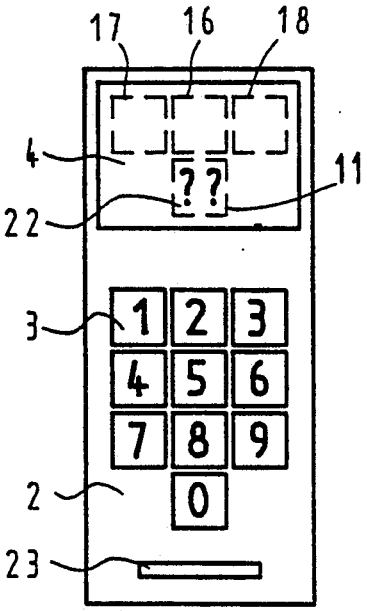
FIG. 5 is a view similar to the FIG. 3 with a third example of the information displayed.

As is shown in the FIGS. 3, 4 and 5, the first, the second, the third and the fourth indicating elements 11, 16, 17 and 18 respectively are arranged in the indicating field 4 of the call registering and indicating apparatus 2. The luminescent diodes of a fifth indicating element 22, formed in the shape of a double question mark for the signaling of a faulty entry, are placed between the luminescent diodes of the first indicating 11 (see the FIG. 5). The driving of the fifth indicating element 22 can, for example, be performed as shown in the document EP-A 0 320 583 identified above. A delivery slot 23 for the tickets is formed adjacent the lower edge of the apparatus 2.

The call registering and indicating apparatus 2 described above operates as follows: On the entry of a call for a certain destination floor by means of the decade keyboard 3, the first indicating element 11 is activated and the entered call is acknowledged through lighting-up of the corresponding decimal number, for which the duration of illumination can be determined by a delay circuit which is shown in the document EP-A 0 320 583. At the same time, the call-storage device 12 associated with the desired destination floor is set. The address formed by the coding circuit 13 and the addresses, which are stored, of the call entry floor and the actuated call registering and indicating apparatus 2 are fed to the serial interface block 14 and combined into a data block which is transmitted by way of the serial bus 8 to the microcomputer systems 5 of the elevators A, B and C. Each microcomputer system 5 now computes a sum from the received data and other data specific to the associated elevator according to an algorithm, for example as shown in the European patent document EP-A 0 356 731. The sums are compared by means of the comparison equipment 6 and the call pair of entry floor call and destination floor call is allocated to that elevator which displays the smallest sum. The microcomputer system 5 concerned now transmits a data block which contains the elevator identification A, B or C and the destination floor number, preferably the ASCII code, by way of the serial bus 8 to the actuated call registering and indicating apparatus 2. The data is fed by way of the serial interface block 14 to the third control circuit 21, from which the matrix is driven, the printer 19 is actuated and a ticket is issued with the imprint of the desired destination floor number and the identification of the allocated elevator. The data merely identifying the allocated elevator and its position relative to the actuated call registering and indicating apparatus 2 is fed to the second control circuit 15 to activate the associated indicating elements 16 and 17 or 18 by way of the associated outputs of the second control circuit 15. In this case, the duration of illumination of the indicating elements 16 and 17 or 18, as well as of the first indicating element 11 signaling the destination floor number, can be restricted to the time of the issue of the ticket.

In a another, not illustrated embodiment, the call registering and indicating apparatus has no optical indicating elements, but is equipped merely with the printer and the ticket-issuing device. It is also possible, in addition to or instead of the optical indicating elements, to provide an acoustic device 24 in the call registering and indicating apparatus 2 by means of which the allocated elevator can be announced. As shown in the FIG. 2, an input of the device 24 can be connected to an output of the second control circuit 15. Furthermore, it can be an advantage to, apart from the indications about the selected destination floor and the allocated elevator, provide additional information on the ticket.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In a hall call registering and indicating apparatus located on a floor at an entryway for elevators with immediate allocation of destination calls, the call registering and indicating apparatus including a decade keyboard for the entry of calls for desired destination floors, call storage devices connected with a group control and an indicating field, the indicating field having a first indicating element signaling the selected destination floor and a second indicating element signaling an allocated elevator, the first indicating element being connected with the decade keyboard by a first control circuit and the second indicating element being connected with the group control by a second control circuit, the improvement comprising: a printer having an input; a ticket-issuing device connected to said printer; a third control circuit having an output connected to said input of said printer; and a serial interface block connected between said third control circuit and the group control, wherein said printer and said ticket-issuing device are responsive to information in a data block generated by the group control after entry at said keyboard of a call representing a selected destination floor and upon allocation of an elevator by the group control to issue a ticket having an imprint indicating at least the selected destination floor and the allocated elevator utilizing the information in the data block.

2. The call registering and indicating apparatus according to claim 1 wherein the first and second indicating elements are optical elements and are illuminated approximately until the ticket is issued.

3. The call registering and indicating apparatus according to claim 1 wherein the second indicating element includes an acoustic device connected to the second control circuit for announcing the allocated elevator.

4. The call registering and indicating apparatus according to claim 1 wherein said printer prints additional information included in the data block on the ticket.

5. A hall call registering and indicating apparatus located at an elevator entryway at a floor for the immediate allocation of destination calls comprising:

a decade keyboard for entering a call to select a desired destination floor connected to a group control for elevators associated with an entryway;

an indicating field having a first indicating element for signaling the selected destination floor of the call entered at said keyboard and a second indicating element for signaling an elevator allocated to the call by the group control;

a first control circuit connected between said first indicating element and said decade keyboard;

a second control circuit connected between said second indicating element and the group control;

a printer and ticket-issuing device; and a third control circuit connected between said printer and the group control whereby said printer and ticket-issuing device is actuated in response to a data block generated by the group control after entry of a call at said decade keyboard and upon allocation of the call to an elevator by the group control to print and issue a ticket having an imprint indicating the selected destination floor and the allocated elevator utilizing information in the data block.

6. The call registering and indicating apparatus according to claim 5 wherein said first and second indicating elements are optical indicating elements and a duration of illumination of said optical indicating elements corresponds to a time required to issue the ticket.

7. The call registering and indicating apparatus according to claim 6 wherein said second indicating element includes an acoustic device connected to said second control circuit for announcing the allocated elevator.

8. The call registering and indicating apparatus according to claim 5 wherein said second indicating element is an acoustic device connected to said second control circuit for announcing the allocated elevator.

9. The call registering and indicating apparatus according to claim 5 wherein said printer and ticket-issuing device prints additional information included in the data block on the ticket.

10. A hall call registering and indicating apparatus located at an elevator entryway at a floor for the immediate allocation of destination calls comprising:

a decade keyboard associated with an elevator entryway for entering calls to select desired destination floors;

call storage devices connected between said decade keyboard and a group control for elevators associated with the entryway;

a first indicating element for signaling a selected destination floor associated with a call entered at said decade keyboard;

a first control circuit connected between said first indicating element and said decade keyboard;

a second indicating element for signaling an elevator allocated by the group control to the call;

a second control circuit connected between said second indicating element and the group control;

a printer for printing tickets;

a ticket-issuing device connected to said printer for issuing the printed tickets; and a third control circuit connected between said printer and the group control whereby said printer is actuated in response to a data block generated by the group control after entry of the call at said decade keyboard and upon allocation of the call to an elevator by the group control to print a ticket having an imprint indicating the selected destination floor and the allocated elevator utilizing information in the data block.

11. The call registering and indicating apparatus according to claim 10 including a serial interface block connected between the group control and said call storage devices.

12. The call registering and indicating apparatus according to claim 11 including a serial interface block connected between the group control and each of said first and second control circuits.

* * * * *